US006408446B1

(12) United States Patent
Carrington

(10) Patent No.: US 6,408,446 B1
(45) Date of Patent: Jun. 25, 2002

(54) PROTECTIVE GARMENT FOR THE HIP AREA

(75) Inventor: Janice Carrington, Valley Forge, PA (US)

(73) Assignee: Plum Enterprises, Inc., Valley Forge, PA (US)

( * ) Notice: Subject to any disclaimer, the term of this patent is extended or adjusted under 35 U.S.C. 154(b) by 0 days.

(21) Appl. No.: 09/538,353

(22) Filed: Mar. 29, 2000

(51) Int. Cl.[7] ..... A41D 13/00
(52) U.S. Cl. ..... 2/465; 2/23
(58) Field of Search ..... 2/456, 455, 465, 2/467, 92, 267, 227, 228, 238, 22–24; 602/23, 61

(56) References Cited

U.S. PATENT DOCUMENTS

| | | | | |
|---|---|---|---|---|
| 1,756,358 A | | 4/1930 | Ingram | |
| 1,774,739 A | | 9/1930 | Voyne | |
| 2,889,830 A | | 6/1959 | Raymond | |
| 3,068,871 A | | 12/1962 | Rapp | |
| 3,526,221 A | | 9/1970 | Garber | |
| 4,302,847 A | | 12/1981 | Miles | |
| 4,561,123 A | | 12/1985 | Hull | |
| 4,573,216 A | | 3/1986 | Wortberg | |
| 4,641,641 A | | 2/1987 | Strock | |
| 4,807,301 A | | 2/1989 | Ferber | |
| 4,894,867 A | * | 1/1990 | Cervolo et al. | 2/238 |
| 4,987,613 A | | 1/1991 | Loverdi et al. | |
| 5,052,052 A | | 10/1991 | Gilford et al. | |
| 5,105,473 A | | 4/1992 | Valtakari | |
| 5,271,101 A | * | 12/1993 | Speth et al. | 2/228 |
| 5,365,610 A | | 11/1994 | Lubahn et al. | |
| 5,383,236 A | | 1/1995 | Sesselman | |
| 5,383,920 A | | 1/1995 | Sikes | |
| 5,433,355 A | | 7/1995 | Watkins | |
| 5,437,618 A | | 8/1995 | Sikes | |
| 5,461,730 A | | 10/1995 | Carrington | |
| 5,497,511 A | | 3/1996 | Zade | |
| 5,500,952 A | | 3/1996 | Keyes | |
| 5,551,082 A | | 9/1996 | Stewart et al. | |
| 5,592,689 A | | 1/1997 | Matthews | |
| 5,636,377 A | * | 6/1997 | Wiener | 2/465 |
| 5,689,836 A | * | 11/1997 | Fee et al. | 2/465 |
| 5,717,997 A | * | 2/1998 | Garcia | 2/23 |
| 6,009,565 A | | 1/2000 | Carrington | |
| 6,040,251 A | * | 3/2000 | Caldwell | 2/83 |

FOREIGN PATENT DOCUMENTS

| | | |
|---|---|---|
| DE | 36 38 718 | 8/1987 |

OTHER PUBLICATIONS

Plum Enterprises, Inc., advertising leaflet for ProtectaHip®.

* cited by examiner

*Primary Examiner*—Gloria M. Hale
*Assistant Examiner*—Tejash Patel
(74) *Attorney, Agent, or Firm*—Drinker Biddle & Reath LLP

(57) ABSTRACT

A pair of protective undershorts for absorbing shock and protecting the hips of the wearer against the shock is disclosed. The undershorts include a pair of large pockets on the inside over the hips, and protective pads in the pockets. Each of the pads extends round approximately ⅓ of the circumference of the wearer. The pads are of a rounded shape, with the upper edge slightly concave, and extend vertically from the hip-bone to below the enarthrodial joint of the hip. The pads are ⅛" thick, and comprise closed-cell foam material with a density of 10.0 to 13.0 lbs/cu. ft., a compression resistance of 9.0 to 13.0 psi, and a tensile strength of at least 150 psi.

21 Claims, 2 Drawing Sheets

PROTECTIVE GARMENT FOR THE HIP AREA

FIELD OF THE INVENTION

The invention relates to a padded or protective garment for the hip area, and more particularly to a shock and stress protective garment that can be worn comfortably and can disperse forces directed toward the hip area, absorbing such forces in the vulnerable regions of the hip.

BACKGROUND OF THE INVENTION

There are over 300,000 hip fractures each year in the United States. Additionally, there are many other types of hip joint injuries that result in pain. Complications associated with hip injuries, such as pneumonia, can result in disruption of normal life, substantial medical costs and even death. These fractures and other injuries are particularly common among the elderly, who experience degenerative changes in bone and tissue structure with advancing age. The degenerative changes become much worse after a hip fracture. In view of ever increasing life expectancies, the number of injuries of this type and the costs associated with them can be expected to increase with time.

The hip joint is an enarthrodial or ball-and-socket joint formed by the reception of a ball-shaped head on the upper or proximal end of the femur into a cup-shaped cavity in the pelvis called the acetabulum. A fall or blow to the hip bone area, if the area is unprotected, can result in body tissue injuries, dislocation of the femur head from the acetabulum, and fractures of the acetabulum or various parts of the proximal femur or other damage in the vicinity of the hip. Particularly vulnerable is the so-called greater trochanter which protrudes outwardly from the proximal femur just below the joint and the adjoining thin neck of the femur. This region is relatively poorly protected by muscle and other body tissue in comparison with the regions of the hip surrounding it. In fact, the greater trochanter is readily accessible to the touch, its position being generally indicated by an elevation in the hip area due to the thinness of the tissues that cover it.

Prior art garments that are capable of providing a measure of protection with respect to these problems are usually difficult to apply and uncomfortable to wear. An effective hip area shock and stress protective garment that is effective, light, sufficiently comfortable to wear for extended periods of time including while sleeping at night, and cosmetically acceptable when worn under clothing during normal daytime activities, is not available.

Commonly invented and assigned U.S. Pat. No. 6,009,565, herein incorporated by reference, discloses an undergarment incorporating pads of shock-absorbing foam material protecting the hip joints of the wearer. An object of the present invention is to further improve on the garment shown and described therein.

SUMMARY OF THE INVENTION

In one aspect of the invention, a protective garment for being disposed against a body to absorb shock and protect selected regions of the body against the shock comprises a protective area for protecting a region of the body disposed adjacent the protective area against the shock and a nonprotective area for providing structural integrity to the garment while providing substantially little protection against the shock to a region of the body disposed against the nonprotective area of the garment. The protective area comprises closed-cell foam material with a density of 10.0 to 13.0 lbs/cu. ft. (160 to 210 kg/m$^3$), a compression resistance of 9.0 to 13.0 psi (60 to 90 N/m$^2$), and a tensile strength of at least 150 psi (1000 N/m$^2$).

In another aspect of the invention, a protective garment comprises a pair of undershorts with a pair of pockets round the sides. A pair of pads of shock-absorbent foam material are placed in and located by the pockets. The pads are so located as to cover the enarthrodial joint regions of the hips of the wearer, extend upwards as far as the hip-bone, and each pad extends horizontally to cover at least one quarter of the circumference of the wearer.

The garment according to the invention may be an orthopedic padded garment, especially protective underwear, a post-surgery placement garment, or geriatric wear for protecting bones and joints, adaptive clothing for the disabled or physically challenged, padded clothing, athletic clothing, or protective clothing, especially pants, shorts or an undergarment. When the garment is athletic clothing, it may be suitable for use in, among other sports, football, hockey, skiing, skating, basketball, baseball, or soccer.

DETAILED DESCRIPTION OF THE DRAWINGS

Figure 1:
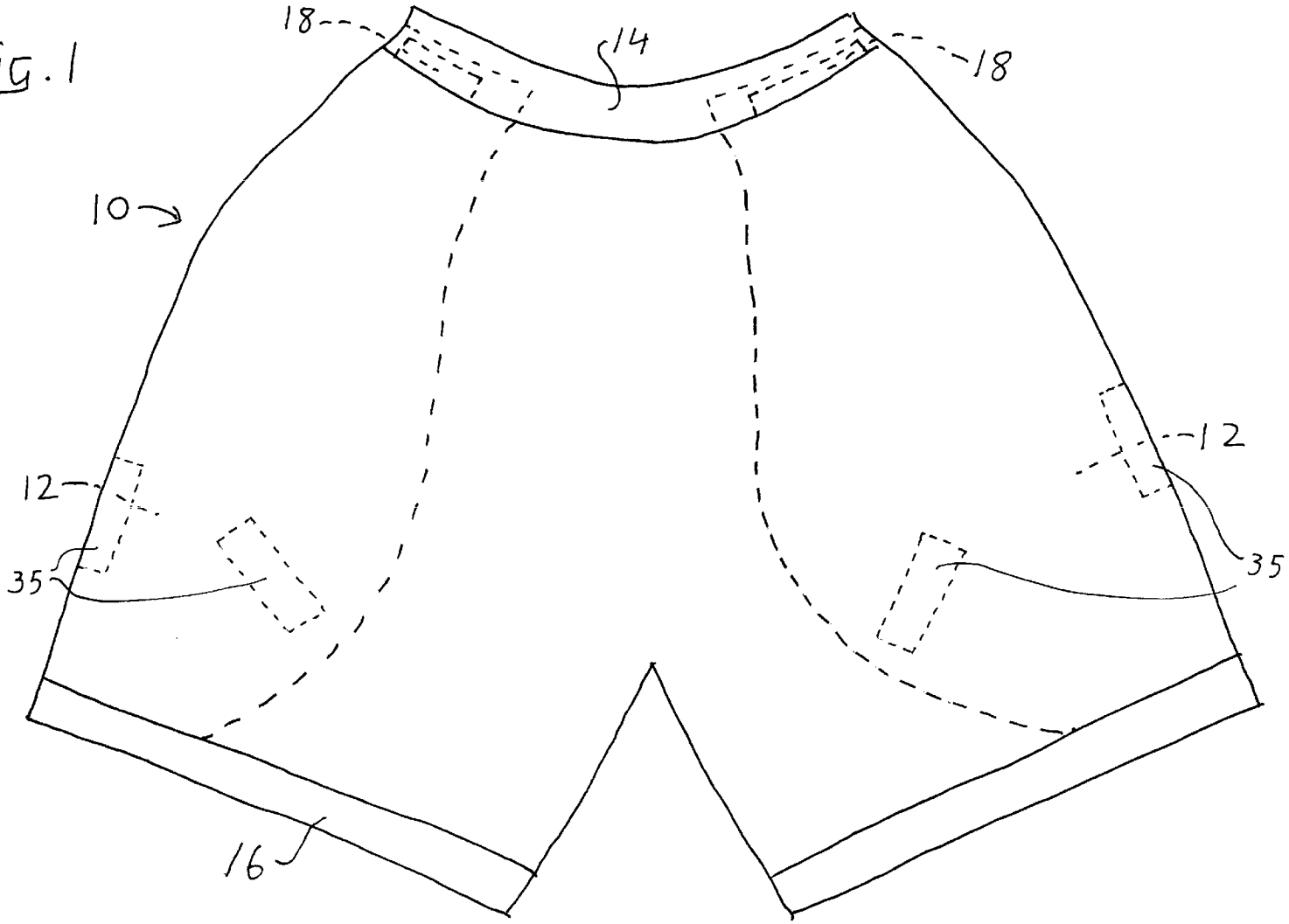
FIG. 1 is a front view of the protective garment of the present invention.

Referring now to FIG. 1, one form of protective garment indicated generally by the reference number 10 is a pair of undershorts that can be worn by a user to absorb shocks and stresses to the hip regions of the body and thereby prevent hip fractures and other types of hip injuries that can result from such shocks and stresses. For example, protective garment 10 can be used to prevent hip injuries due to shocks and stresses to the hip regions associated with falls suffered by the user.

The undershorts 10 may be made of any suitable material, such as cotton, nylon, polyester, spandex, elastic, or lace. Such materials provide a desirable degree of durability and resistance to soiling, as well as an acceptable feel and conventional appearance to the undershorts 10. The preferred material is a machine-washable cotton knit stretch interlock fabric. The undershorts may be made in any conventional design. The undershorts 10 should fit closely over the body of the wearer, without actually being skintight.

On the inside, the undershorts are provided with a pair of large pockets 12. The pockets 12 are sewn to the inside of the undershorts. The pockets 12 extend vertically from the waistband 14 to the tops of the leg hems 16. Horizontally, each of the pockets extends round approximately one third of the circumference of the undershorts 10, extending symmetrically front and back. The central front and rear portions of the undershorts 10 have no similar pockets. The tops of the pockets 12 are not sewn in, but are attached to the waistband 14 by hook-and-loop fasteners 18. Where the waistband 14 is elasticated or otherwise of adjustable length, the hook-and-loop fasteners 18 are preferably in the form of two or more comparatively short pieces of fastener. The top edge of the pocket 12 then does not need to be of adjustable length. It can accommodate the contraction of the waistband 14 by becoming slack between the fasteners 18.

Figure 2:
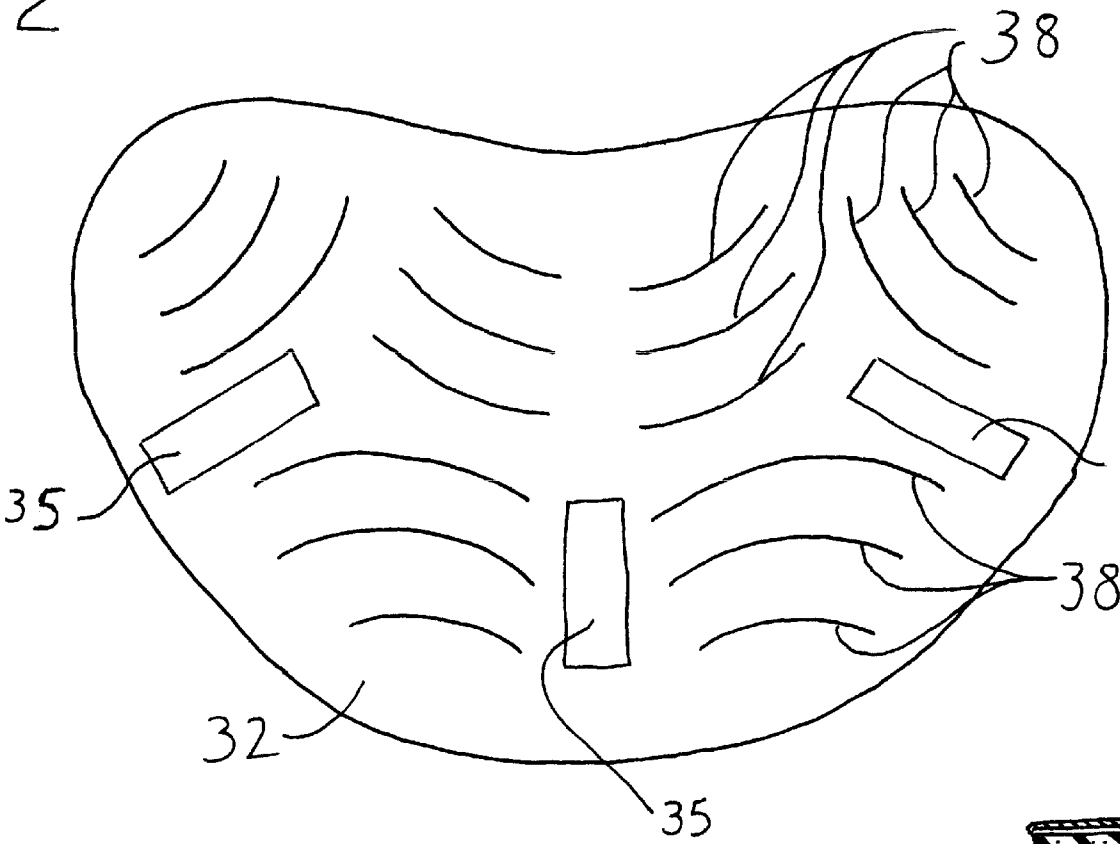
FIG. 2 is a plan view of a shock absorbing pad suitable for use with the protective garment of the present invention.
Figure 3:
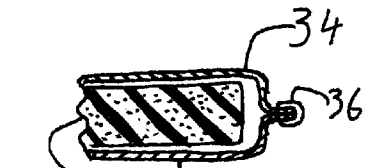
FIG. 3 is a sectional view through part of the shock absorbing pad shown in FIG. 2.

Referring now to FIGS. 2 and 3, a shock absorbing pad indicated generally by the reference number 30 which can be used in the undershorts 10 is formed of a shock absorbing core 32 and shell pieces 34 for encapsulating the shock absorbing core 32. The shock absorbing pad 30 is shaped to be operatively disposed within one of the pockets 12 so that it overlies and fully protects the hip of the wearer.

As may be seen from FIG. 2, the pads 30 are approximately "kidney-shaped." That is to say, they are rounded, longer than they are wide, with one long. side concave and the other convex. The pads are placed in the pockets 12 with the concave side uppermost. As may be seen from FIG. 1, the lower edges of the pockets 12 are curved, so that the convex lower edge of the pad 30 fits snugly into the pocket, with little freedom of movement. When the undershorts 10 are used, the pad 30 wraps around the hip area of the user. However, because the pad 30 is not particularly elastic, it tends to form into a part-cylindrical or part-conical shape. As a result, if the top edge of the pad 30 projects above the hipbone of the wearer, it may tend to project away from the wearer's body, causing an unsightly bulge. The concave upper edge of the pad 30 reduces that tendency.

The pads 30 are not fastened to the undershorts 10. One pair of pads can be removed from one pair of undershorts 10 and placed in a different pair of undershorts 10, improving cost-effectiveness. The pads 30 are symmetrical, so that the user does not need to distinguish a left side pad from a right side pad, or to distinguish the front end of the pad from the rear end of the pad or the inside of the pad from the outside, when putting the pads into the pockets 12.

The pads 30 are sufficiently large that each of them extends round at least a quarter, and preferably a third, of the circumference of the wearer. Pads 30 for a normal adult may be approximately 16" long and 10" high. The large size of the pads 30 affords protection against intertrochanteric, transcervical, and subtrochanteric fractures of the hip. The large pads 30 also help to prevent skin breakdown in wearers who are confined to a wheelchair or to bed for prolonged periods.

In order to allow for greater adaptability to the needs of a particular wearer, the pockets 12 may be made larger than the pads 30, so that the exact position of the pads can be adjusted. In order to secure the pads 30 in an adjusted position, patches of hook-and-loop fastening material 35 are provided on the pads 30 and on the insides of the pockets 12. The hook-and-loop fastening material 35 may be provided only on the faces of the pads 30 that face away from the wearer, and on the corresponding surface of the pockets 12, in order to avoid the patches of hook-and-loop fastening material pressing or rubbing against the wearer's skin. However, if in the interests of symmetry patches of hook-and-loop fastening material 35 are provided on both faces of the pads 30, then it is preferably the loop part of the material that is on the pads 30.

The shell pieces 34 are stitched together around their peripheries and outside the periphery of the shock absorbing core 32. Thus, the shell pieces 34 should be approximately the same shape as the core 32 with which they are associated, and slightly larger. The shell pieces 34 can be formed of any suitable material, such as cotton, nylon, or polyester. Such materials provide a desirable degree of durability and resistance to soiling, as well as an acceptable feel and conventional appearance to protective garment 10. The preferred material is a machine-washable cotton knit stretch interlock fabric. The shell pieces 34 may be stitched together with machine overlock stitching 36 such as is well known in the garment industry.

Further details of the construction of pads suitable for use as the shock absorbing pads 30 are set forth in commonly invented and assigned U.S. Pat. No. 5,461,730, which is incorporated by reference herein. However, in distinction to the shock absorbing pads described in U.S. Pat. No. 5,461,730, the shock-absorbing core 32 of the pad 30 is formed of a high-density closed-cell impact absorbent material having a density of 10.0 to 13.0 lbs/cu. ft. (160 to 210 kg/m$^3$), a compression resistance of 9.0 to 13.0 psi (60 to 90 N/m$^2$), and a tensile strength of at least 150 psi (1000 N/m$^2$). A suitable material is sold by Uniroyal under the name ENSOLITE, Type SCC.

The use of a high density foam rather than a relatively lower density foam permits the core 32 to be made thinner and more cosmetically acceptable for a desired amount of shock absorption. This is desirable since it is preferable that the protective undershorts 10 be as nearly as possible undetectable in normal social settings, and it is thus desirable for the bulk of the pads 30 not to show through the wearer's outer garments. It has been found that a pad 30 with a core 32 only ⅛" (3 mm) thick provides a useful amount of protection for the hips of many wearers. However, if a greater level of protection is desired in particular circumstances, two pads 30 may be put into each pocket 12.

The shock absorbing core 32 can be provided with a plurality of slits 38. The slits 38 increase the flexibility of the core 32, and make it easier for the initially flat core 32 to conform to the compound curvatures of the hip region of the wearer of the undershorts 10. As may be seen from FIG. 2, the slits 38 are placed so as to run in a counter-direction to the muscle groups surrounding the hip joint of the wearer. This tends to enhance safe, unencumbered movement by the wearer. The slits 38 also allow air to pass through the otherwise impermeable core 32. The slits 38 thus enhance ventilation, thereby making the undershorts 10 more comfortable during extended periods of wear.

It will be understood by those skilled in the art that, because the shock absorbing pads 32 are formed of closed-cell foam, they do not absorb water, and that they are therefore substantially waterproof. Thus, they can be laundered in the same way as the garment 10, and it is not necessary, although it may be preferred, to remove them from the pockets 12 before laundering the garment.

Although the invention has been described and illustrated with respect to exemplary embodiments thereof, it should be understood by those skilled in the art that various changes, omissions, and additions may be made therein and thereto, without departing from the spirit and scope of the present invention.

What is claimed is:

1. A protective garment to be worn by a person to absorb shock and to protect selected regions of the body against the shock, comprising:

a plurality of protective areas located to cover the enarthrodial Joint regions of the hips of the wearer, extending upwards as far as the hip-bone, and extending horizontally to cover at least one quarter of the circumference of the wearer, for protecting said enarthrodial joint regions against shock; and a nonprotective area for providing structural integrity to the garment while providing substantially little protection against the shock to a region of the body disposed against the nonprotective area of the garment;

each protective area comprising a pad of closed-cell foam material with a density of 10.0 to 13.0 lbs/cu. ft., a compression resistance of 9.0 to 13.0 psi, and a tensile strength of at least 150 psi, and each said pad has a plurality of slits therethrough, the slits placed so as to run in a counter-direction to the muscle groups surrounding the hip joint of the wearer.

2. The protective garment of claim 1, wherein said foam material has a thickness of between ⅛ inch and 1 inch.

3. The protective garment of claim 2, wherein said foam material has a thickness of substantially ⅛ inch.

4. The protective garment of claim 1, wherein said protective area comprises a pad of said foam material detachably secured to said nonprotective area.

5. The protective garment of claim 4, wherein the said protective area comprises at least one pocket containing the said pad of the said foam material.

6. The protective garment of claim 4, wherein the said pad of the said foam material, and the inside of the said pocket, are provided with complementary areas of hook-and-loop fastening material arranged to hold the pad in position within the pocket.

7. The protective garment of claim 1, which comprises a pair of undershorts.

8. A protective garment comprising:

a pair of shorts with a pair of pockets round the sides; and a pair of pads of shock-absorbent foam material placed in and located by the pockets;

the pads being so located as to cover the enaithrodial joint regions of the hips of the wearer, extending upwards as far as the hip-bone, and extending horizontally to cover at least one quarter of the circumference of the wearer;

each of the pads having a plurality of slits therein, the slits are positioned so as to run in a counter-direction over the muscle groups surrounding the hip joint of the wearer.

9. The protective garment of claim 8, wherein said protective pad is resilient.

10. The protective garment of claim 9, wherein said protective pad comprises foam material.

11. The protective garment of claim 10, wherein said foam material comprises closed cell foam material.

12. The protective garment of claim 8, wherein said protective pad has a thickness of between ⅛ inch and 1 inch.

13. The protective garment of claim 8, wherein the said pads of the said foam material, and the insides of the said pockets, are provided with complementary areas of hook-and-loop fastening material arranged to hold the pads in position within the pockets.

14. The protective garment of claim 8, wherein said slits arranged symmetrically from side to said about a central area of the pad.

15. The protective garment of claim 8, wherein at least a part of the slits are arranged at radial positions surrounding the central area of the pad.

16. The protective garment of claim 8, wherein said slits are curved.

17. The protective garment of claim 8, wherein said slits are arranged in a plurality of groups, with the slits in each group generally parallel to one another.

18. The protective garment of claim 17, wherein the slits comprise first and second groups, the first and second groups are disposed in front of and behind said enarthrodial joint, respectively, with respect to the orientation of the garment when worn by a standing person, and are concave towards the hip bone; wherein the slits further comprise third and fourth groups, said third and fourth groups are disposed below said first and second groups, respectively, and are concave downwards; and wherein the slits further comprise fifth and sixth groups, said fifth and sixth groups are disposed in front of said first and behind said second groups of slits, respectively, and are concave away from the center of said pad, with respect to the orientation of the garment when worn by a standing person.

19. A protective garment to be worn by a person to absorb shock and protect selected regions of the body against the shock, the garment comprising:

a plurality of protective areas for protecting the enarthrodial joint regions of the wearer against shock, the protective areas located to cover the enarthrodial joint regions of the hips of the wearer, the protective areas extending upwards as far as the hip-bone and extending horizontally to cover at least one quarter of the circumference of the wearer; and a nonprotective area for providing structural integrity to the garment and for securing the protective areas adjacent the enarthrodial regions of the wearer;

each protective area comprising a resilient pad, each pad having a plurality of slits therein for increasing the flexibility of the pad and conformity of the pad to the enarthrodial regions of the wearer;

the slits in each pad being placed so as to form a central slit-free area over the enarthrodial joint, first and second groups of slits extending outwards and upwards in an upper part of said pad on either side of said central area, third and fourth groups of slits extending outwards in a lower part of said pad on either side of said central area, and fifth and sixth groups of slits extending outwards and downwards in a part of said pad outside said first and second groups of slits.

20. The protective garment of claim 19, wherein said slits are curved.

21. The protective garment of claim 20, wherein said first and second groups of curved slits are concave inwardly and upwardly, said third and fourth groups of slits are concave downwardly, and said fifth and sixth groups of slits are concave outwardly and upwardly, with respect to the orientation of the garment when worn by a standing person.

* * * * *